United States Patent [19]

Nitta

[11] Patent Number: 4,762,254

[45] Date of Patent: Aug. 9, 1988

[54] PRESSURE CONTAINER FOR AEROSOL

[75] Inventor: Tomio Nitta, Yokohama, Japan

[73] Assignee: Tokai Corporation, Kanagawa, Japan

[21] Appl. No.: 924,245

[22] Filed: Oct. 27, 1986

[30] Foreign Application Priority Data

Nov. 8, 1985 [JP] Japan ..... 60-170889[U]

[51] Int. Cl.[4] ..... B65D 83/14

[52] U.S. Cl. ..... 222/402.24; 222/402.1

[58] Field of Search ..... 222/396, 402.1, 402.24, 222/394, 402.21, 402.22, 464, 402.2

[56] References Cited

U.S. PATENT DOCUMENTS

| | | | |
|---|---|---|---|
| 2,570,909 | 10/1951 | Benson et al. | 222/464 X |
| 3,325,053 | 6/1967 | De Boer et al. | 222/396 X |
| 3,343,730 | 9/1967 | Erich-Arthur Nier et al. | 222/402.24 |
| 3,615,042 | 10/1971 | Marand | 222/402.24 X |
| 3,955,720 | 5/1976 | Malone | 222/396 |
| 4,030,644 | 6/1977 | Creighton | 222/396 |
| 4,519,528 | 5/1985 | Comment | 222/396 |

FOREIGN PATENT DOCUMENTS

| | | | |
|---|---|---|---|
| 1242793 | 6/1967 | Fed. Rep. of Germany | 222/464 |
| 14637 | 1/1984 | Japan . | |
| 10864 | 1/1984 | Japan . | |
| 1179892 | 2/1970 | United Kingdom | 222/402.1 |

*Primary Examiner*—Michael S. Huppert

*Attorney, Agent, or Firm*—Armstrong, Nikaido, Marmelstein & Kubovcik

[57] ABSTRACT

A pressure container for dispensing a flowable product in the form of an aerosol. The pressure container includes a container body having a hollow plug welded to an inner surface of the body. A spring-loaded spouting tube having a valve port is slidably received in the plug with a portion of the tube projecting above the plug. An annular deformable gasket is disposed about the spouting tube for normally closing the valve port. An externally threaded guide member is disposed about the spouting tube and is seated on the gasket. An actuator having a spray nozzle is fitted on the spouting tube projecting portion.

3 Claims, 2 Drawing Sheets

PRESSURE CONTAINER FOR AEROSOL

BACKGROUND OF THE INVENTION

This invention relates to pressure containers for aerosol of the type in which liquid medicine, cosmetic or the like is sealed in the bomb under high pressure and the liquid content is spouted from the bomb upon the opening of the valve.

PRIOR ARTS

There have been proposed and practically employed a variety of pressure containers for aerosol and one of the prior art pressure containers for aerosol is shown in FIG. 4 of the accompanying drawings. Referring to FIG. 4, the prior art pressure container for aerosol shown in FIG. 4 generally comprises a metal pressure resisting bomb 1 having an annular bulge 2 formed by curving the upper edge of the neck of the bomb outwardly, downwardly and then radially inwardly. An annular gasket is disposed on the top of the bulge 2, a housing 5 is disposed on the upper surface of the annular gasket and an annular resilient gasket - valve member 9 is disposed on the upper surface of the housing 5. A mounting cap 3 having a through opening in the top wall surrounds the bulge 2, gasket 4, housing 5 and valve member 9 with the skirt of the cap deformed radially inwardly to abut against the bulge 2 to hold the gasket 4, housing and valve member 9 in position. The housing 5 includes a radially outwardly extending annular top wall 5*a*, an annular projection 5*b* extending vertically downwardly from the top wall and substantially closed on the bottom to engage the bulge 2 to thereby pinch the bulge between the projection and the deformed skirt of the cap 3, a larger diameter upper cylindrical portion 5*c* extending downwardly from the top wall at the central area thereof and a smaller diameter lower cylindrical portion 5*d* extending downwardly from the larger diameter upper portion to define a shoulder 5*e* in cooperation with the bottom of the upper portion. A spouting tube 6 having a valve port 8 therein extends through the aligned openings in the mounting cap 3 and valve member 9 with a portion of the spouting tube projecting above the mounting cap 3. A spring 7 is disposed between the spouting tube 6 and the shoulder 5*e* to normally bias the spouting tube upwardly so as to close the valve port 8. A dipping tube 10 is fitted in the smaller diameter lower cylindrical portion 5*d* of the housing 5 with a lower portion of the tube dipped in a body of aerosol within the bomb 1. An actuator 12 is fitted on the projecting upper portion of the spouting tube 6 and a spray nozzle 13 is horizontally disposed within the actuator 12 with one end opening into the atmosphere and the other end in communication with the cavity in the actuator which in turn communicates with the spouting tube 6. In use, when the spouting tube 6 is depressed down against the force of the spring 7 by the operation of the actuator 12, the resilient gasket - valve member 9 is deformed downwardly to uncover the valve port 8 whereupon the aerosol is allowed to flow from the bomb through the dipping tube 10, the housing 5, the now open valve port 8, the spouting tube 6 and the actuator 12 to the spray nozzle 13 from which the aerosol is sprayed into the atmosphere.

In the above-mentioned pressure container for aerosol, since the individual components have to be placed one upon another in assembling the components, the assembling operation is complicated, requires a great deal of labour and encounters difficulty in the assembling operation. And since the final sealing between the adjacents components is effected by tightening the mounting cap, a number of gaskets are required resulting in increasement in the number of areas to be sealed and thus, the probability of leakage is high. Furthermore, the conventional pressure container for aerosol is complicated in construction and expensive accordingly.

SUMMARY OF THE INVENTION

Therefore, the present invention is to provide a pressure container for aerosol which eliminates the drawback inherent in the prior art pressure container for aerosol described hereinabove, which minimizes the number of areas to be sealed by the gasket or gaskets to thereby lessen the probability of leakage, which is simple in construction and easy to assemble high safety feature and which can be produced at less expense.

According to the present invention, there is provided a pressure container for aerosol which comprises an open top synthetic resin container body, a synthetic resin hollow plug rigidly connected to the interior of the partially threaded opening of the body by means of ultrasonic welding to provide an airtight unitary structure, said plug defining a valve chamber in communication with the interior of said container body, a spring-loaded spouting tube received in the valve chamber with a portion of the tube projecting above the plug for vertically slidable movement and having a valve port in the side wall of the spouting tube, an annular threaded gasket in threaded engagement with the interior of the spouting chamber and an annular gasket - valve member disposed between the threaded guide member and an annular shoulder on the valve chamber for normally closing the valve port and uncovering the valve port when the spouting tube is depressed down.

In the pressure container for aerosol of the type according to the present invention described hereinabove, the spouting tube is normally biased upwardly under the force of the spring whereby the gasket closes the valve port, but when the spouting tube is depressed down against the force of the spring, the gasket is deformed to uncover the valve port whereby aerosol contained in the container body is sprayed.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

PREFERRED EMBODIMENT OF THE INVENTION

Figure 1:
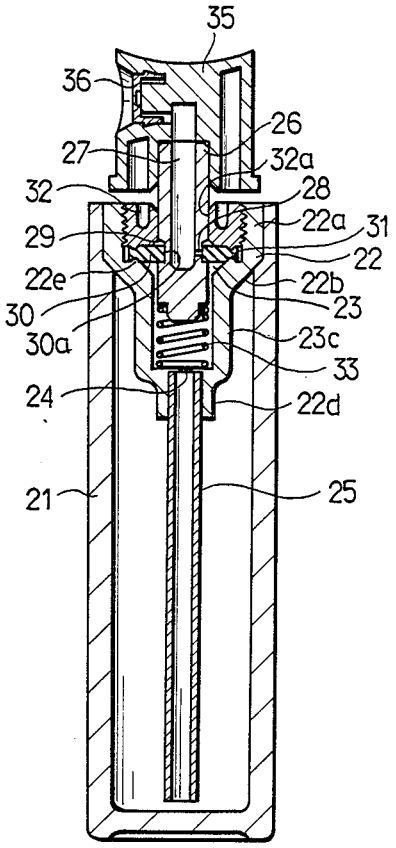
FIG. 1 is a vertically sectional view of the preferred embodiment of the pressure container for aerosol constructed in accordance with the principle of the invention.
Figure 2:
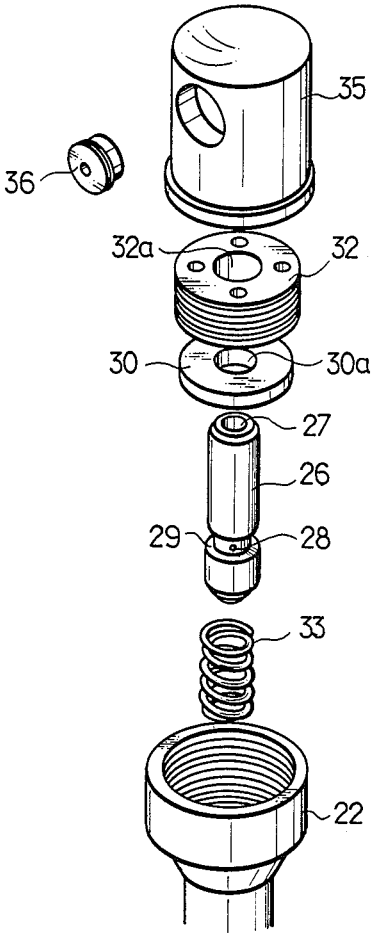
FIG. 2 is a fragmentary exploded perspective view of the pressure container for aerosol shown in FIG. 1 with the container body removed therefrom.
Figure 3:
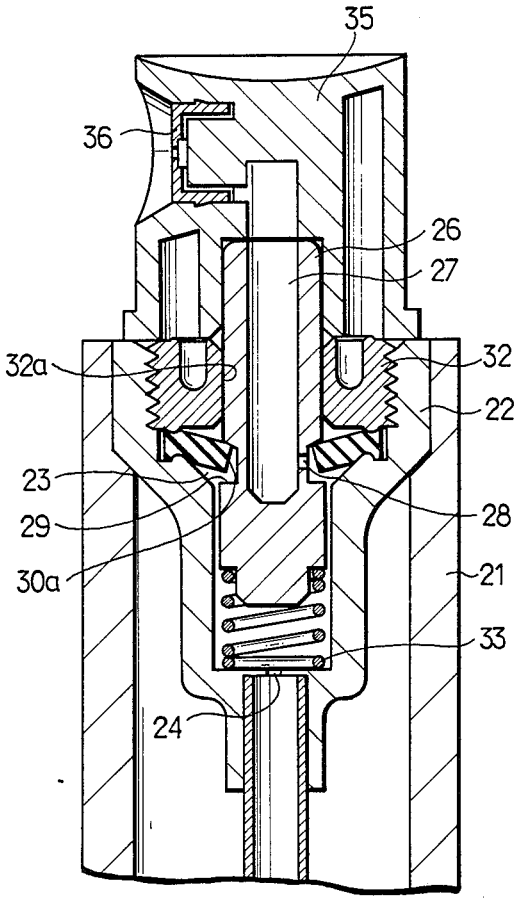
FIG. 3 is a fragmentary vertically sectional view on an enlarged scale showing the operation of the container.
Figure 4:
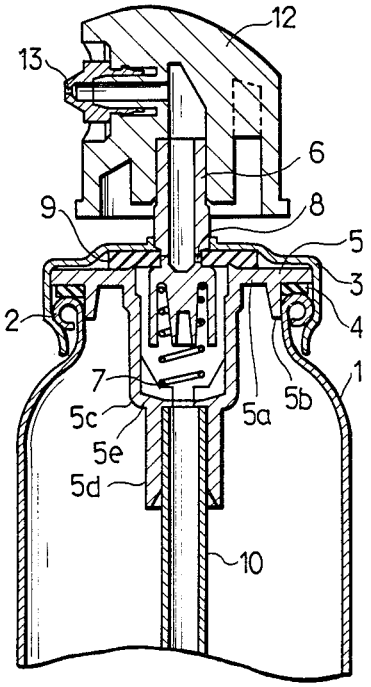
FIG. 4 PRIOR ART
FIG. 4 is a fragmentary vertically sectional view of a prior art pressure container for aerosol.

The present invention will be now described referring to the accompanying drawings and more particularly, to FIGS. 1 to 3 thereof in which the preferred embodiment of the pressure container for aerosol of the invention is shown.

The pressure container for aerosol generally comprises an open top hollow cylindrical body formed of synthetic resin 21 and an open top hollow plug formed of synthetic resin 22 fitted in the open top of the body 21. The body 21 and plug 22 are rigidly connected together into a unitary structure by means of ultrasonic welding in pressure resisting and airtight relationship.

The plug 22 defines an open top valve chamber 23 therein and the bottom of the valve chamber 23 is formed with a through opening or inlet 24 which is in communication with the interior of the container body 21.

The plug 22 includes a uniform largest diameter internally threaded uppermost portion **22*a*, a downwardly tapered portion 22*b* extending downwardly from the uppermost portion 22*a*, a uniform intermediate diameter intermediate portion 22*c* extending downwardly from the tapered portion 22*b* and having the bottom of the valve chamber 23 provided with the opening 24 and a uniform smallest diameter lowermost portion 22*d* extending downwardly from the intermediate portion 22*c*. An annular recess 22*a* is formed in the inner surface of the boundary between the uppermost portion 22*a* and tapered portion 22*b* for the purpose to be described hereinafter. A dipping tube 25 is fitted at the upper end thereof in the lowermost portion 22*d* of the plug and extends vertically downwardly into a body of aerosol contained in the container body 21**.

A vertically slidable spouting tube 26 is centrally disposed in the open top of the valve chamber 23 in the plug 22 with a portion thereof projecting above the container body and plug. The spouting tube 26 defines a spouting opening 27 which is closed at the lower end. The spouting tube 26 is formed about the lower end portion thereof with an annular recess 29 in communication with the spouting opening 27 and a lateral valve port 28 opening into the annular recess 29. A ring-shaped gasket 30 seats on the shoulder **22*e* of the plug and is received within the annular recess 29 in the spouting tube 26 and the gasket has a center opening 30*a* the inner surface of which normally seals the valve port 28 which opens into the annular recess 29. An externally threaded guide 32 is in engagement with the threaded inner surface of the uppermost portion 22*a* of the plug 22 to abut against the upper surface of the gasket 30 to thereby maintain airtight between the inner surface of the valve chamber 23 and the undersurface of the gasket 30. The guide member 32 has a center through opening 32*a* in which the spouting tube 26** slides axially.

The spouting tube 26 is normally urged to protrude above the tops of the container body 21 and plug 22 under the force of a spring 33 disposed between the inner surface of the bottom of the valve chamber 23 in the plug 22 and the inner end face of the spouting tube 26.

An actuator 35 is detachably fitted on the protruding upper end of the spouting tube 26 and has a spray nozzle 36 extending laterally therefrom and having one end in communication with the spouting opening 27 in the spouting tube 26 and the other end opening into the atmosphere so that aerosol contained in the container body 21 is sprayed into the atmosphere in the manner as will be described hereinafter.

With the above-mentioned construction and arrangement of the components of the pressure container for aerosol according to the present invention, when the container is in its closed or inoperative condition, the spouting tube 26 is maintained in its biased position protruding above the container body and plug under the force of the spring 33 and the valve port 28 is closed by the inner surface of the gasket 30 which also serves as a valve member as shown in FIG. 1. In use, the user pushes the actuator 35 down to push the spouting tube 26 downwardly against the force of the spring 33 so that the upper edge of the annular recess 29 in the spouting tube 26 bends the gasket 30 downwardly which in turn uncovers the valve port 28 as shown in FIG. 3 whereupon the aerosol contained in the container body 21 is allowed to flow through the dipping tube 25, the valve chamber 23, the open valve port 28 and the spouting tube 26 into the spray nozzle 36 from which the aerosol is sprayed.

As described hereinabove, according to the present invention, since the synthetic resin plug is rigidly connected to the uppermost portion of the synthetic resin container body by means of ultrasonic welding, the externally threaded guide member is in threaded engagement with the thread on the uppermost threaded portion and the valve mechanism comprising the valve member - gasket and spouting tube is assembled to the unitary container body - plug assembly, the assembling of the plug to the container body and the assembling of the valve mechanism to the container body - plug assembly can be separately and simply performed. Furthermore, since the plug is secured to the container body by means of ultrasonic welding, the single gasket which concurrently functions as the single valve member is sufficient to ensure sealing and thus, in the pressure container for aerosol of the present invention, the chance of leakage is less as compared with the prior art pressure containers for aerosol and sealing reliance is higher than the prior art pressure containers for aerosol. Finally, because of the simplified assembling operation, the pressure container for aerosol of the invention is less expensive.

Although only one specific embodiment of the invention has been described and illustrated herein, many changes and xodifications will of course suggest themselves to those skilled in the art. This single embodiment has been selected for this disclosure for the purpose of illustration only. The present invention should therefore not be limited to the embodiment so selected, the true scope of the invention being defined only in the appended claims.

What is claimed is:

1. A pressure container for aerosol comprising:

a synthetic resin container body open at only one end thereof, a hollow synthetic resin plug fitted internally of said one open end of said container body and sealed by means of ultrasonic welding to form a unitary structure with said container body, said hollow synthetic resin plug defining a valve chamber having an inlet in communication with the interior of said container body at one end thereof and a uniform largest diameter upper most portion having a threaded inner surface, a downwardly tapered portion extending downwardly from said uppermost portion, a uniform intermediate diameter intermediate portion extending downwardly from said tapered portion and a smallest diameter lowermost portion extending downwardly from said intermediate portion, a spring loaded spouting tube received in said valve chamber with a portion thereof protruding above said container body and plug for vertical slidable movement, a valve port in a side wall of said spouting tube and a communication groove in communication with said valve port in the side wall of said spouting tube, an annular threaded guide in threaded engagement with said threaded inner surface of said valve chamber, an annular shoulder formed on the inner surface of said valve chamber, said annular shoulder being spaced from said threaded inner surface and defining the upper edge of a downwardly tapered internal surface of said downwardly tapered portion of said hollow plug and an annular deformable gasket interposed between said annular shoulder and said guide for normally closing said valve port whereby when said spouting tube is depressed down against said spring force, said annular deformable gasket is deformed to uncover said valve port and allow aerosol flow from said inlet to said spouting tube with said downwardly tapered internal surface providing an inclined annular surface limiting downward movement of said gasket.

2. The pressure container for aerosol as defined by claim 1, further including an actuator detachably fitted on said protruding portion of said spouting tube and a spray nozzle mounted in said actuator and having one end opening into the atmosphere and the other end in communication with a hollow interior of said spouting tube.

3. The pressure container for aerosol as defined by claim 1, further including a dipping tube fitted in said smallest diameter lowermost portion of said hollow synthetic resin plug and extending downwardly therefrom into a body of aerosol contained in said container body and a spring interposed between said intermediate diameter intermediate portion of said hollow plug and a lower end face of said spouting tube for normally biasing the spouting tube upwardly to close said valve port.

* * * * *